US010102969B2

(12) United States Patent
Park et al.

(10) Patent No.: US 10,102,969 B2
(45) Date of Patent: Oct. 16, 2018

(54) METHOD OF MANUFACTURING ELECTRONIC COMPONENT

(71) Applicant: SAMSUNG ELECTRO-MECHANICS CO., LTD., Suwon-Si, Gyeonggi-Do (KR)

(72) Inventors: Moon Soo Park, Suwon-Si (KR); Jong Sik Yoon, Suwon-Si (KR); Kyung Han Ahn, Suwon-Si (KR); Dong Hwan Lee, Suwon-Si (KR); Hye Yeon Cha, Suwon-Si (KR); Jong Ho Lee, Suwon-Si (KR)

(73) Assignee: SAMSUNG ELECTRO-MECHANICS CO., LTD., Suwon-si, Gyeonggi-Do (KR)

( * ) Notice: Subject to any disclaimer, the term of this patent is extended or adjusted under 35 U.S.C. 154(b) by 309 days.

(21) Appl. No.: 14/942,768

(22) Filed: Nov. 16, 2015

(65) Prior Publication Data

US 2016/0189863 A1 Jun. 30, 2016

(30) Foreign Application Priority Data

Dec. 24, 2014 (KR) ..... 10-2014-0189117

(51) Int. Cl.

*H01F 41/04* (2006.01)
*H01F 17/00* (2006.01)
*H01F 17/04* (2006.01)

(52) U.S. Cl.

CPC ..... *H01F 41/046* (2013.01); *H01F 17/0013* (2013.01); *H01F 17/04* (2013.01); *H01F 2017/048* (2013.01); *Y10T 29/49078* (2015.01)

(58) Field of Classification Search

CPC .. H01F 17/0013; H01F 17/04; H01F 41/0233; H01F 41/0246; H01F 41/041; H01F 41/042; H01F 41/043; H01F 41/046; H01F 41/12; H01F 41/125; H01F 2017/048

See application file for complete search history.

(56) References Cited

U.S. PATENT DOCUMENTS 7,212,094 B2 5/2007 Matsutani et al.
2005/0068150 A1 3/2005 Matsutani et al.
(Continued)

FOREIGN PATENT DOCUMENTS

CN 1685452 A 10/2005
CN 102428608 A 4/2012
(Continued)

OTHER PUBLICATIONS

Machine translation of JP 2013-055232 provided by EPO website (Espacenet.com) on Feb. 16, 2018.*
(Continued)

*Primary Examiner* — A. Dexter Tugband
*Assistant Examiner* — Joshua D Anderson
(74) *Attorney, Agent, or Firm* — McDermott Will & Emery LLP

(57) ABSTRACT

A method of manufacturing an electronic component having high inductance (L) and an excellent quality (Q) factor and direct current (DC)-bias characteristics includes forming a magnetic body in which internal coil parts are embedded, and forming a cover part including a magnetic metal plate on at least one of upper and lower portions of the magnetic body.

17 Claims, 12 Drawing Sheets

(56) References Cited

U.S. PATENT DOCUMENTS

| | | | | |
|---|---|---|---|---|
| 2010/0259353 | A1 | 10/2010 | Saito et al. | |
| 2012/0062435 | A1* | 3/2012 | Kato | H01Q 7/06 343/787 |
| 2013/0169401 | A1* | 7/2013 | Lee | H01F 27/29 336/192 |
| 2014/0049212 | A1* | 2/2014 | Sawa | H01F 38/14 320/108 |
| 2014/0266543 | A1 | 9/2014 | Park et al. | |
| 2015/0123604 | A1* | 5/2015 | Lee | H01F 38/14 320/108 |
| 2017/0053741 | A1* | 2/2017 | Stark | H01F 27/255 |

FOREIGN PATENT DOCUMENTS

| | | | |
|---|---|---|---|
| CN | 104011814 | A | 8/2014 |
| JP | 3807438 | B2 | 9/2006 |
| JP | 2008-166455 | A | 7/2008 |
| JP | 2008-258399 | A | 10/2008 |
| JP | 2010-087240 | A | 4/2010 |
| JP | 2013-055232 | A | 3/2013 |
| JP | 2014-183307 | A | 9/2014 |
| KR | 10-2010-0113029 | A | 10/2010 |
| WO | 2011/121933 | A1 | 10/2011 |

OTHER PUBLICATIONS

Machine translation of JP 2008-166455 provided by EPO website (Espacenet.com) on Feb. 16, 2018.*

Korean Office Action dated Nov. 6, 2015, issued in corresponding Korean Patent Application No. 10-2014-0189117. (w/ English translation).

Chinese Office Action dated May 3, 2017, issued in Chinese Patent Application No. 201510870652.5. (w/ English translation).

Second Office Action issued in Chinese Patent Application No. 201510870652.5 dated Nov. 1, 2017 (with English Abstract).

* cited by examiner

METHOD OF MANUFACTURING ELECTRONIC COMPONENT

CROSS-REFERENCE TO RELATED APPLICATION

This application claims benefit of priority to Korean Patent Application No. 10-2014-0189117 filed on Dec. 24, 2014, with the Korean Intellectual Property Office, the disclosure of which is incorporated herein by reference.

TECHNICAL FIELD

The present disclosure relates to a method of manufacturing an electronic component.

BACKGROUND

An inductor, an electronic component, is a representative passive element configuring an electronic circuit, together with a resistor and a capacitor, to remove noise therefrom.

Inductors are manufactured by forming an internal coil part in a magnetic body including a magnetic material and forming external electrodes on external surfaces of the magnetic body.

SUMMARY

An aspect of the present disclosure may provide a method of manufacturing an electronic component having high inductance (L) and an excellent quality (Q) factor, and direct current (DC)-bias characteristics (change characteristics in inductance, depending on the application of a current).

According to an aspect of the present disclosure, a method of manufacturing an electronic component may include forming a magnetic metal plate on at least one of an upper portion and a lower portion of a magnetic body in which internal coil parts are embedded.

According to another aspect of the present disclosure, a method of manufacturing an electronic component may include stacking a magnetic metal plate and thermosetting resin layers on at least one of upper and lower portions of the magnetic metal plate to form a laminate, compressing the laminate to pulverize the magnetic metal plate into a plurality of metal fragments, and forming the laminate in which the magnetic metal plate is pulverized, on at least one of upper and lower portions of a magnetic body in which internal coil parts are embedded.

According to another aspect of the present disclosure, a method of manufacturing an electronic component may include forming a magnetic body embedded with internal coil parts and forming a cover part including a pulverized magnetic metal plate on at least one of upper and lower portions of the magnetic body.

BRIEF DESCRIPTION OF DRAWINGS

The above and other aspects, features and other advantages of the present disclosure will be more clearly understood from the following detailed description taken in conjunction with the accompanying drawings, in which.

DETAILED DESCRIPTION

Figure 1:
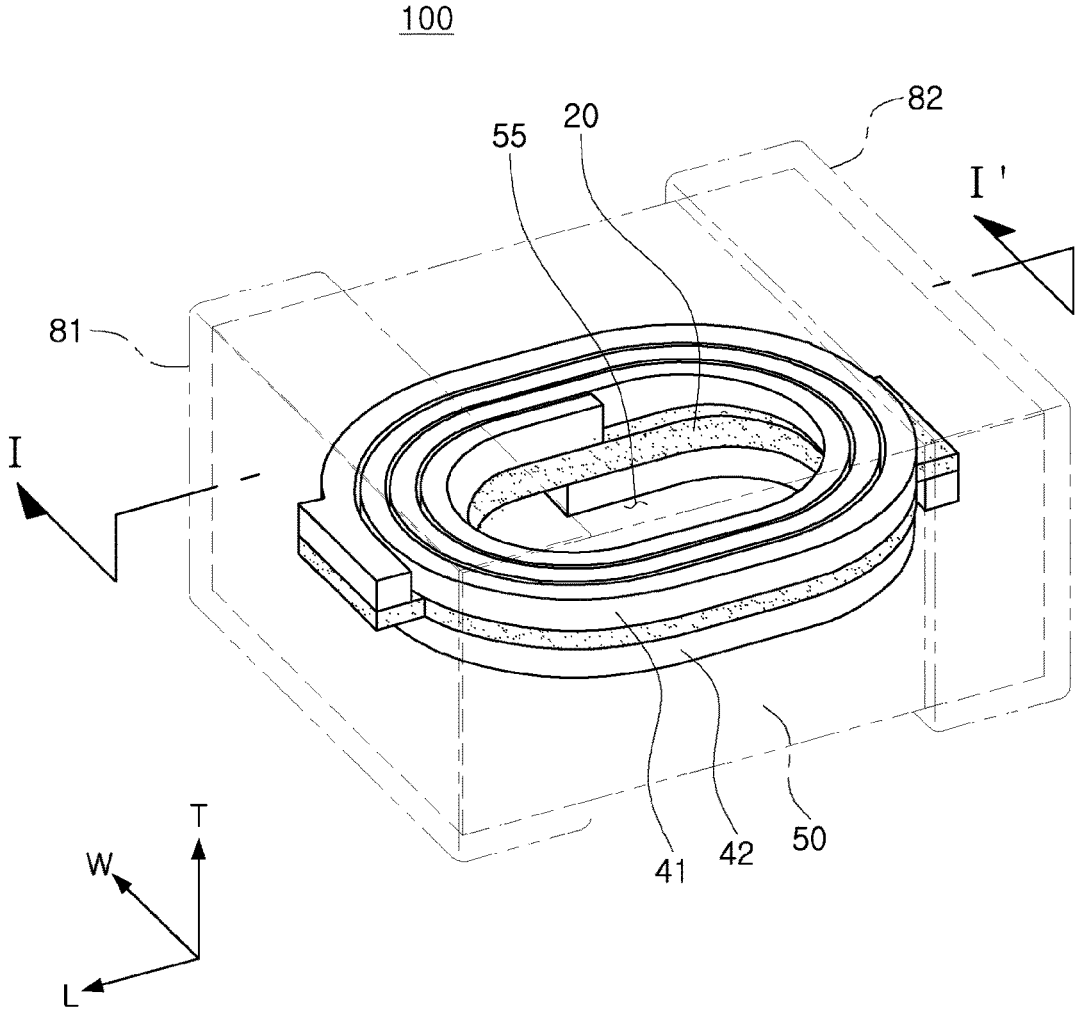
FIG. 1 is a perspective view schematically illustrating an internal coil part of an electronic component manufactured according to an exemplary embodiment in the present disclosure.

Hereinafter, embodiments of the present disclosure will be described in detail with reference to the accompanying drawings.

The disclosure may, however, be embodied in many different forms and should not be construed as being limited to the embodiments set forth herein. Rather, these embodiments are provided so that this disclosure will be thorough and complete, and will fully convey the scope of the disclosure to those skilled in the art.

In the drawings, the shapes and dimensions of elements may be exaggerated for clarity, and the same reference numerals will be used throughout to designate the same or like elements.

Hereinafter, an electronic component manufactured according to an exemplary embodiment in the present disclosure, for example, a thin film type inductor, will be described. However, the electronic component according to exemplary embodiments in the present disclosure is not limited thereto.

FIG. 1 is a perspective view schematically illustrating an internal coil part of an electronic component manufactured according to an exemplary embodiment in the present disclosure.

Referring to FIG. 1, as an example of the electronic component, a thin film type inductor used in a power line of a power supply circuit is illustrated.

An electronic component 100 according to an exemplary embodiment in the present disclosure may include a magnetic body 50, internal coil parts 41 and 42 embedded in the magnetic body 50, and first and second external electrodes 81 and 82 disposed on external surfaces of the magnetic body 50 and connected to the internal coil parts 41 and 42.

In the electronic component 100 according to an exemplary embodiment in the present disclosure, a 'length' direction refers to an 'L' direction of FIG. 1, a 'width' direction refers to a 'W' direction of FIG. 1, and a 'thickness' direction refers to a 'T' direction of FIG. 1.

The electronic component 100 according to the exemplary embodiment in the present disclosure may include a first internal coil part 41 having a flat coil shape and formed on one surface of an insulating substrate 20 and a second internal coil part 42 having a flat coil shape and formed on the other surface of the insulating substrate 20 opposing the one surface thereof.

The first and second internal coil parts 41 and 42 may have a spiral shape, and the first and second internal coil parts 41 and 42 formed on one surface and the other surface of the insulating substrate 20, respectively, may be electrically connected to each other by a via (not shown) penetrating through the insulating substrate 20.

The insulating substrate 20 may have a through-hole formed in a central portion thereof to penetrate therethrough, in which the through-hole may be filled with a magnetic material to form a core part 55. The core part 55 may be filled with the magnetic material to improve an inductance (L).

However, the insulating substrate 20 is not necessarily included. The internal coil part may also be formed of a metal wire without including the insulating substrate.

One end portion of the first internal coil part 41 formed on one surface of the insulating substrate 20 may be exposed to one end surface of the magnetic body 50 in the length (L) direction thereof, and one end portion of the second internal coil part 42 formed on the other surface of the insulating substrate 20 may be exposed to the other end surface of the magnetic body 50 in the length (L) direction thereof.

However, one end portions of the respective first and second internal coil parts 41 and 42 are not limited to being exposed as described above, but one end portion of each of the first and second internal coil parts 41 and 42 may be exposed to at least one surface of the magnetic body 50.

The first and second external electrodes 81 and 82 may be formed on the external surfaces of the magnetic body 50 to be connected to the first and second internal coil parts 41 and 42 exposed to the end surfaces of the magnetic body 50, respectively.

Figure 2:
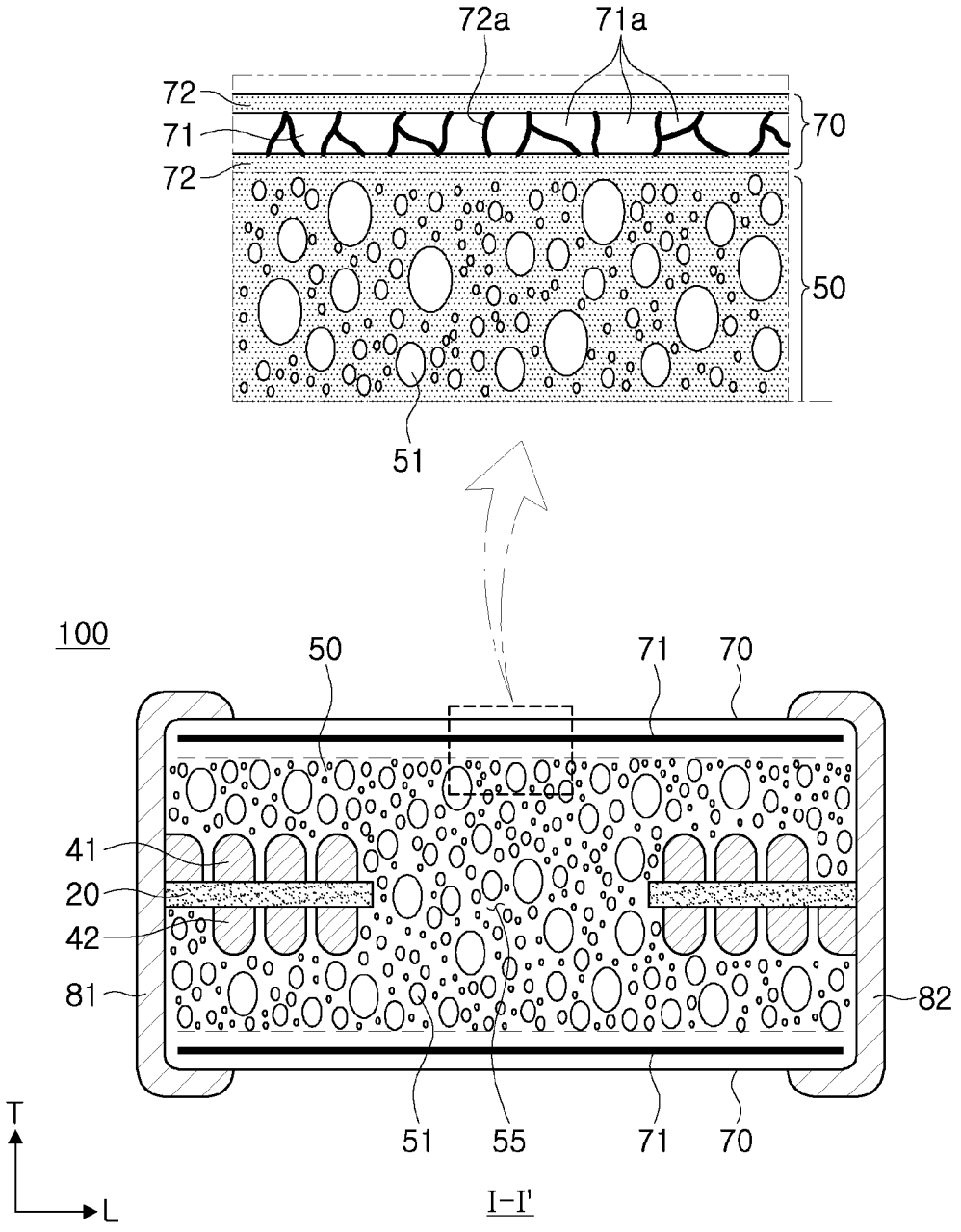
FIG. 2 is a cross-sectional view taken along line I-I' of FIG. 1.

FIG. 2 is a cross-sectional view taken along line I-I' of FIG. 1.

Referring to FIG. 2, the magnetic body 50 of the electronic component 100 manufactured according to the exemplary embodiment in the present disclosure may include magnetic metal powder particles 51. However, the magnetic body 50 is not limited to including the magnetic metal powder particles 51, and may include any magnetic powder particles exhibiting magnetic properties.

The electronic component 100 manufactured according to the exemplary embodiment in the present disclosure may include a cover part 70 including a magnetic metal plate 71 disposed on at least one of upper and lower portions of the magnetic body 50 including the magnetic metal powder particles 51.

A boundary between the magnetic body 50 and the cover part 70 may be able to be confirmed using a scanning electron microscope (SEM), but the magnetic body 50 and the cover part 70 may not necessarily be differentiated from each other by the boundary observed by the scanning electron microscope (SEM). For example, a region thereof in which magnetic metal plate 71 is included may be differentiated as the cover part 70.

The cover part 70 including the magnetic metal plate 71 may have a degree of permeability greater than that of the magnetic body 50 including the magnetic metal powder particles 51. Further, the cover part 70 including the magnetic metal plate 71 may serve to prevent a magnetic flux from leaking to the outside.

Accordingly, the electronic component 100 manufactured according to the exemplary embodiment in the present disclosure may implement relatively high inductance and excellent DC-bias characteristics.

The magnetic metal powder particles 51 may be spherical powder particles or plate-shaped, for example, flake powder particles.

The magnetic metal powder particles 51 may be formed of crystalline metal or amorphous metal including at least one or more selected from the group consisting of iron (Fe), silicon (Si), boron (B), chromium (Cr), aluminum (Al), copper (Cu), niobium (Nb), and nickel (Ni).

For example, the magnetic metal powder particles 51 may be Fe—Si—B—Cr-based spherical amorphous metal particles.

The magnetic metal powder particles 51 may be included in a thermosetting resin such as an epoxy resin and a polyimide resin in a form in which they are dispersed in the thermosetting resin.

Permeability of the magnetic metal plates 71 may be about two to ten times greater than that of the magnetic metal powder particles 51, and the magnetic metal plates 71 may be disposed above and below the magnetic body 50 to prevent a magnetic flux from leaking to the outside.

The magnetic metal plates 71 may be formed of a crystalline metal or an amorphous metal including at least one selected from the group consisting of iron (Fe), silicon (Si), boron (B), chromium (Cr), aluminum (Al), copper (Cu), niobium (Nb), and nickel (Ni).

The magnetic metal plates 71 according to the exemplary embodiment in the present disclosure may be formed of a plurality of pulverized metal fragments 71*a*.

When the magnetic metal plates are used in plate form without being pulverized, permeability of the magnetic metal plates may be about two to ten times as high as that of the magnetic metal powder particles 51, but a core loss of the magnetic metal plates may be greatly increased due to an eddy current and thus a Q factor thereof may deteriorate.

Therefore, according to the exemplary embodiment in the present disclosure, the magnetic metal plates 71 may be pulverized to form the plurality of metal fragments 71*a*, thereby implementing the high permeability and reducing the core loss.

Accordingly, the electronic component 100 manufactured according to the exemplary embodiment in the present disclosure may improve permeability, thereby securing high inductance and satisfying the requirement for an excellent Q factor.

The cover part 70 may further include thermosetting resin layers 72 disposed on at least one or both of the upper and lower portions of the magnetic metal plates 71.

The thermosetting resin layers 72 may include a thermosetting resin such as the epoxy resin and the polyimide resin.

A thermosetting resin 72*a* may be disposed in a space between adjacent metal fragments 71*a* of the pulverized magnetic metal plates 71.

The thermosetting resin 72*a* disposed in the space between the adjacent metal fragments 71*a* may insulate the adjacent metal fragments 71*a* from each other.

As a result, core loss of the metal magnetic plate 71 may be reduced and the Q factor thereof may be improved.

Figure 3:
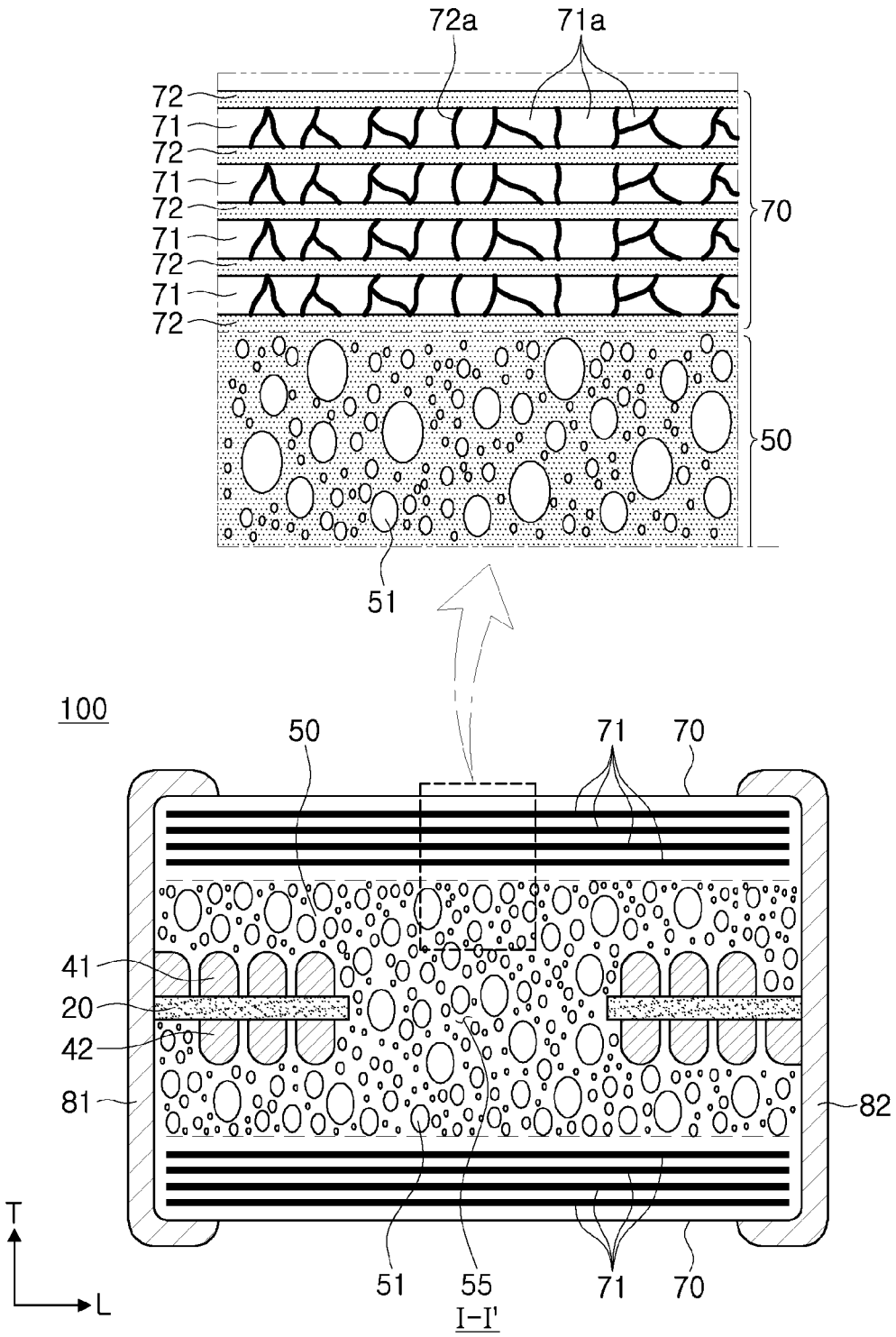
FIG. 3 is a cross-sectional view of an electronic component manufactured according to another exemplary embodiment in the present disclosure taken in L-T directions.

FIG. 3 is a cross-sectional view of an electronic component manufactured according to another exemplary embodiment in the present disclosure, taken in L-T directions.

Referring to FIG. 3, the cover part 70 of the electronic component 100 manufactured according to another exemplary embodiment in the present disclosure may include a plurality of the magnetic metal plates 71.

The cover part 70 may include the magnetic metal plates 71 stacked in a plurality of layers.

The cover part 70 may have the plurality of magnetic metal plates 71 and the thermosetting resin layers 72 alternately stacked therein.

The thermosetting resin layers 72 may be formed between the plurality of magnetic metal plates 71 to insulate the adjacently stacked magnetic metal plates 71 from each other.

The thermosetting resin 72*a* may be disposed in the space between the adjacent metal fragments 71*a* of each pulverized magnetic metal plate 71 and the thermosetting resin 72*a* disposed in the space between the adjacent metal fragments 71*a* may insulate the adjacent metal fragments 71*a* from each other.

The cover part 70 may include the plurality of magnetic metal plates 71, thereby further improving permeability and securing a relatively high degree of inductance.

For instance, the cover part 70 may include the magnetic metal plates 71 in an amount of four or more.

Figure 4A:
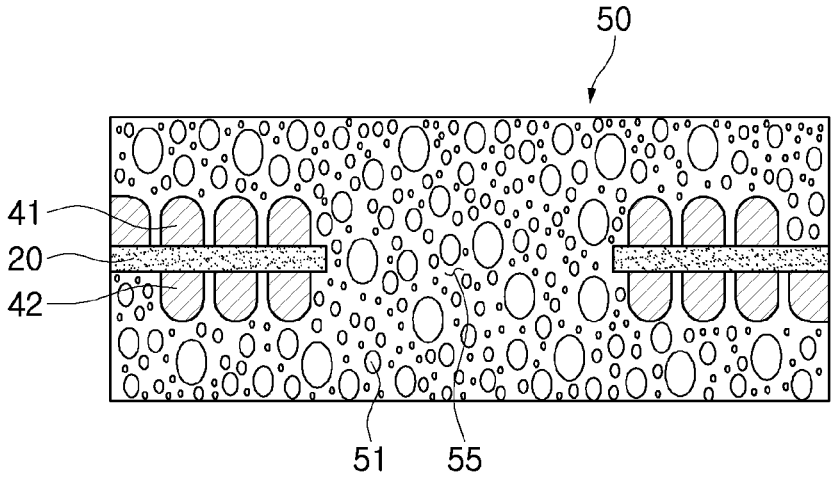
FIGS. 4A and 4B are views illustrating a manufacturing process of an electronic component according to an exemplary embodiment in the present disclosure.
Figure 4B:
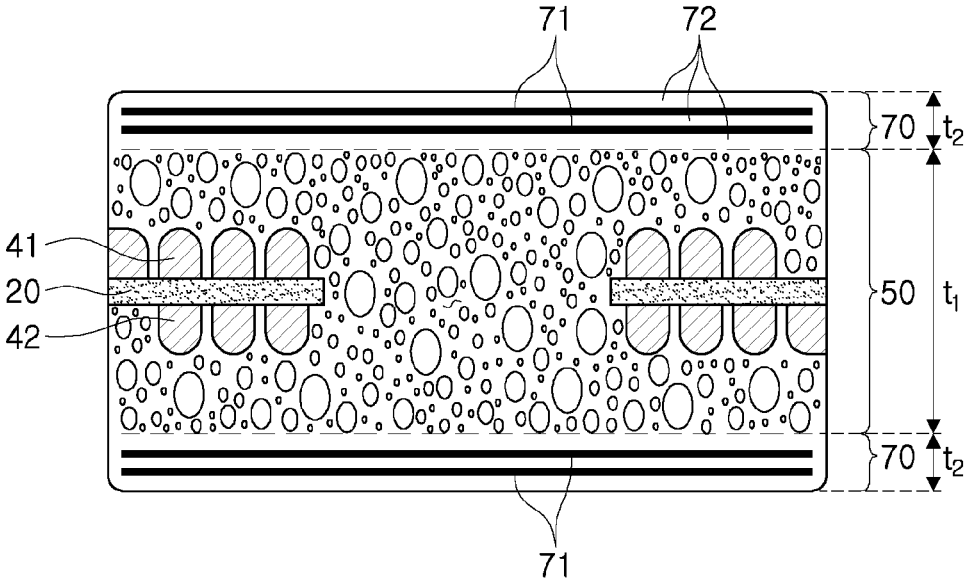

FIGS. 4A and 4B are views illustrating a manufacturing process of an electronic component according to an exemplary embodiment in the present disclosure.

Referring to FIG. 4A, first, the magnetic body 50 in which the internal coil parts 41 and 42 are embedded may be formed.

The magnetic body 50 may include the magnetic metal powder particles 51.

A method of forming magnetic body 50 is not particularly limited, but any method of forming a magnetic metal powder-resin composite in which the internal coil parts are embedded may be used.

The magnetic body 50 may include a mixture of magnetic metal powder particles having a relatively large average particle size and magnetic metal powder particles having a relatively small average particle size.

The magnetic metal powder particles having a relatively large average particle size may allow for relatively high permeability, and the magnetic metal powder particles having a relatively small average particle size may be mixed with the magnetic metal powder particles having a relatively large average particle size to improve a filling rate. As the filling rate thereof is increased, the permeability thereof may be improved.

Further, using the magnetic metal powder particles having a relatively large average particle size may implement the high permeability but increase the core loss. On the other hand, the magnetic metal powder particles having a relatively small average particle size are a low core loss material, and thus, mixing the magnetic metal powder particles having a relatively small average particle size with the magnetic metal powder particles having a relatively large average particle size may offset the core loss increasing due to the use of the magnetic metal powder particles having a relatively large average particle size to improve the Q factor.

Accordingly, the magnetic body 50 may include the mixture of the magnetic metal powder particles having a relatively large average particle size with the magnetic metal powder particles having an average particle size smaller than that of the magnetic metal powder particles having the relatively large average particle size, to improve the inductance and the Q factor.

However, permeability may not be greatly improved through only the mixing of the magnetic metal powder particles having a relatively large average particle size with the magnetic metal powder particles having a relatively small average particle size.

According to the exemplary embodiment in the present disclosure, the magnetic metal plates 71 may be further formed to more improve permeability.

Referring to FIG. 4B, the cover parts 70 including the magnetic metal plates 71 may be formed above and below the magnetic body 50.

The magnetic body 50 and the cover parts 70 including the magnetic metal plates 71 may be integrated by being compressed and hardened by a laminate method or an isostatic pressing method.

When a thickness of the magnetic body 50 including the magnetic metal powder particles 51 is $t_1$ and a thickness of the cover part 70 including the magnetic metal plates 71 is $t_2$, the thickness $t_2$ of each of the cover parts 70 may range from 10% to 30% of the thickness $t_1$ of the magnetic body 50.

When the thickness $t_2$ of the cover part 70 is less than 10% of the thickness $t_1$ of the magnetic body 50, the effect of improving permeability and reducing the leakage magnetic flux may be degraded and when the thickness $t_2$ of the cover part 70 exceeds 30% of the thickness $t_1$ of the magnetic body 50, the core loss may be increased and the Q factor may deteriorate.

FIGS. 4A and 4B illustrate that the magnetic metal plates 71 are disposed above and below the magnetic body 50 to form the cover parts 70, but the formation of the cover part 70 is not limited thereto. For example, any method capable of achieving the effect of the present disclosure by forming the magnetic metal plate of at least one layer may be used.

For example, the cover parts 70 including the magnetic metal plates 71 may also be formed on side surfaces of the magnetic body 50, or may also be formed in the magnetic body 50, instead of being disposed above and below the magnetic body 50.

Figure 5A:
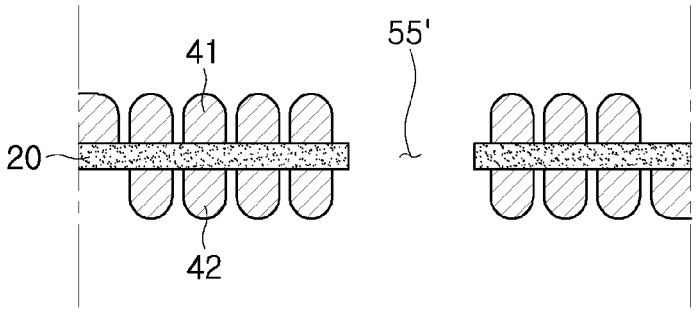
FIGS. 5A and 5B are views illustrating a process of forming a magnetic body of the electronic component according to the exemplary embodiment in the present disclosure.
Figure 5B:
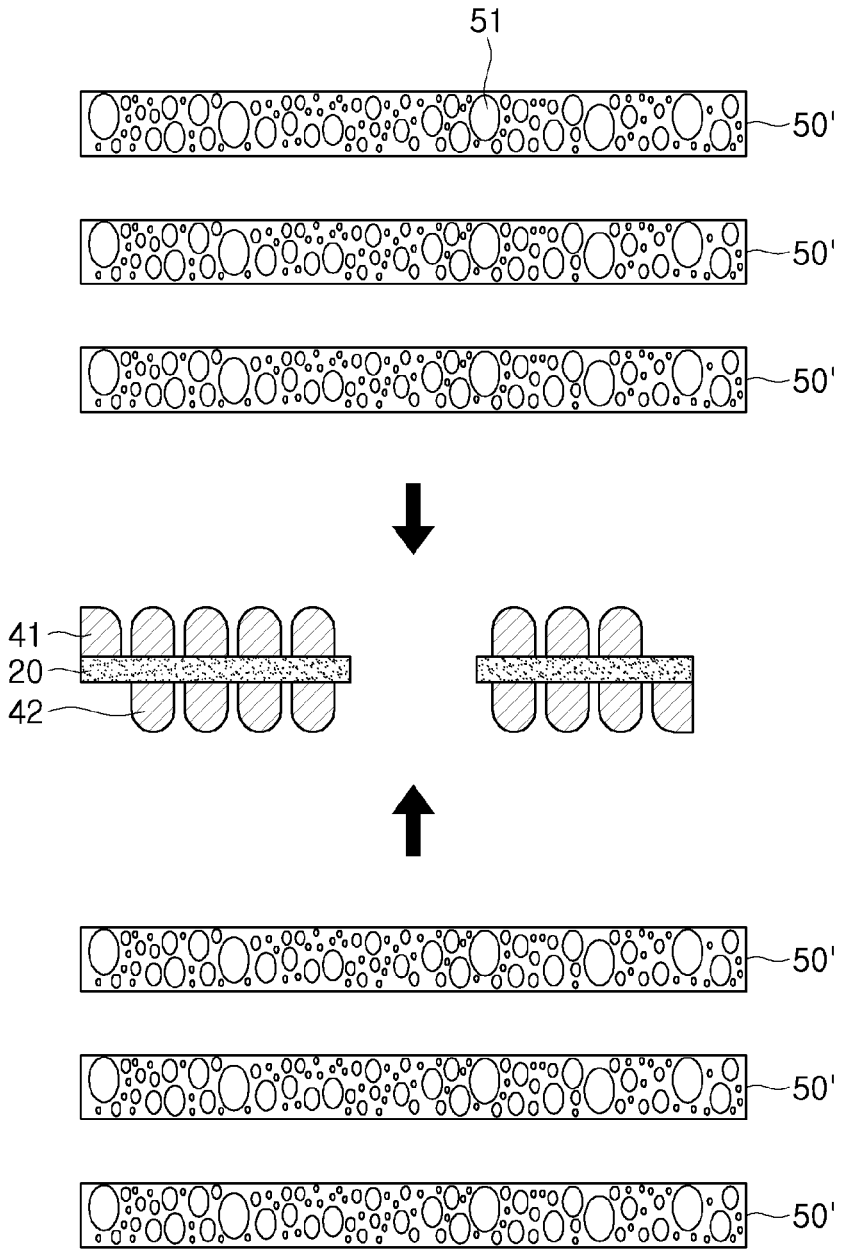

FIGS. 5A and 5B are views illustrating a process of forming a magnetic body of an electronic component according to an exemplary embodiment in the present disclosure.

Referring to FIG. 5A, the first and second internal coil parts 41 and 42 may be formed on one surface and the other surface of the insulating substrate 20.

A via hole (not illustrated) may be formed in the insulating substrate 20, a plating resist having an opening may be formed on the insulating substrate 20, and the via hole and the opening may be filled with a conductive metal by the plating to form the first and second internal coil parts 41 and 42 and a via (not shown) connecting the first and second internal coil parts 41 and 42 to each other.

The first and second internal coil parts 41 and 42 and the via may be formed using a conductive metal having excellent electrical conductivity, for example, silver (Ag), palladium (Pd), aluminum (Al), nickel (Ni), titanium (Ti), gold (Au), copper (Cu), platinum (Pt), or an alloy thereof, etc.

However, a method of forming internal coil parts 41 and 42 is not limited to the above-mentioned plating, and the internal coil parts may also be formed by a metal wire.

An insulating film (not shown) coating the first and second internal coil parts 41 and 42 may be formed on the first and second internal coil parts 41 and 42.

The insulating film (not shown) may be formed by a method well-known in the art such as a screen printing method, a photo-resist (PR) exposure and development method, a spray application method, or the like.

The first and second internal coil parts 41 and 42 may be coated with the insulating film (not shown), such that the first and second internal coil parts 41 and 42 may not directly contact magnetic materials forming the magnetic body 50.

The insulating substrate 20 may be, for example, a polypropylene glycol (PPG) substrate, a ferrite substrate, a metal-based soft magnetic substrate, or the like.

In a region of the insulating substrate 20 in which the first and second internal coil parts 41 and 42 are not formed, a central portion thereof may be removed to thus form a core part hole 55' in the central portion of the insulating substrate 20.

A partial removal of the insulating substrate 20 may be carried out by mechanical drilling, laser drilling, sand blasting, punching, or the like.

Referring to FIG. 5B, magnetic sheets 50' may be stacked on the upper and lower portions of the first and second internal coil parts 41 and 42.

The magnetic sheets 50' may be manufactured by mixing the magnetic metal powder particles 51 with organic materials such as a thermosetting resin, a binder and a solvent to prepare slurry, applying the slurry to a carrier film at a thickness of several tens of micrometers using the doctor blade method, and drying the slurry.

The magnetic metal powder particles 51 may be the spherical powder particles or the plate-shaped, for example, flake powder particles.

The magnetic sheets 50' may be manufactured by mixing the magnetic metal powder particles having a relatively large average particle size with the magnetic metal powder particles that have an average particle size smaller than that of the magnetic metal powder particles having the relatively large average particle size.

The magnetic sheets 50' may be manufactured by dispersing the magnetic metal powder particles 51 in the thermosetting resin such as an epoxy resin and a polyimide resin.

The magnetic body 50 in which the internal coil parts 41 and 42 are embedded may be formed by stacking, compressing, and hardening the magnetic sheets 50'.

Here, the core part hole 55' may be filled with magnetic materials to form the core part 55.

However, FIG. 5B illustrates that the magnetic sheets 50' are stacked to form the magnetic body 50, but the formation of the magnetic body 50 is not limited thereto. For example, any method capable of forming the magnetic metal powder-resin composite in which the internal coil parts are embedded may be used.

FIGS. 6A through 6E are views illustrating a process of forming a cover part of the electronic component including a magnetic metal plate according to the exemplary embodiment in the present disclosure.

Figure 6A:
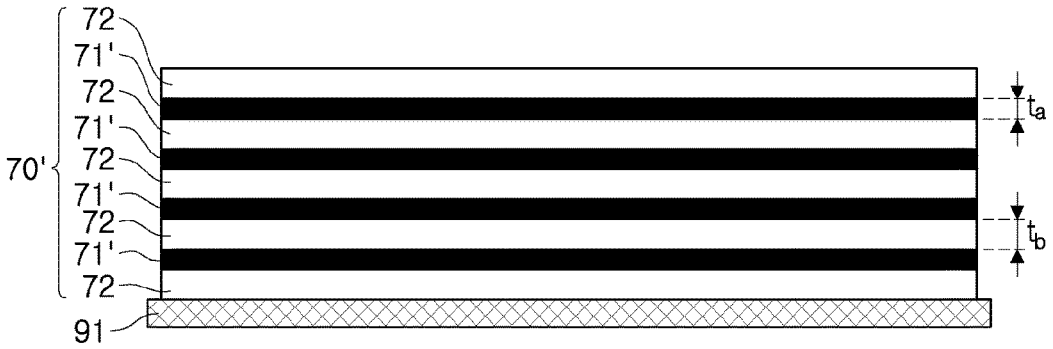
FIGS. 6A through 6E are views illustrating a process of forming a cover part including a magnetic metal plate of the electronic component according to the exemplary embodiment in the present disclosure.

Referring to FIG. 6A, magnetic metal plates 71' and the thermosetting resin layers 72 may be alternately stacked on a support film 91 to form a laminate 70'.

The support film 91 may not particularly be limited as long as it may support the laminate 70'. For example, a polyethylene terephthalate (PET) film, a polyimide film, a polyester film, a polyphenylene sulfide (PPS) film, a polypropylene (PP) film, a fluorine resin-based film such as polyterephthalate (PTFE), or the like may be used.

A thickness of the support film 91 may range from 20 μm to 50 μm.

The magnetic metal plates 71' may be formed of crystalline metal or amorphous metal including at least one selected from the group consisting of iron (Fe), silicon (Si), boron (B), chromium (Cr), aluminum (Al), copper (Cu), niobium (Nb), and nickel (Ni).

A thickness $t_a$ of the magnetic metal plate 71' may range from 5 μm to 50 μm.

When the thickness $t_a$ of the magnetic metal plate 71' is less than 5 μm, the effect of improving permeability and reducing leakage magnetic flux may deteriorate. When the thickness $t_a$ of the magnetic metal plate 71' exceeds 50 μm, the magnetic metal plate 71' may not be properly pulverized and a Q factor of the magnetic metal plate 71' may be degraded due to the increase in the core loss.

The thermosetting resin layers 72 may include the thermosetting resin such as the epoxy resin, the polyimide resin, and the like.

A thickness $t_b$ of the thermosetting resin layer 72 may be 1.0 to 2.5 times the thickness $t_a$ of the magnetic metal plate 71'.

When the thickness $t_b$ of the thermosetting resin layer 72 is less than 1.0 times the thickness $t_a$ of the magnetic metal plate 71', the insulating effect between the adjacent magnetic metal plates 71' and the adjacent metal fragments 71*a* may be degraded. When the thickness $t_b$ of the thermosetting resin layer 72 exceeds 2.5 times the thickness $t_a$ of the magnetic metal plate 71', the effect of improving permeability may be degraded.

For example, the thickness $t_a$ of the thermosetting resin layer 72 may be 1.5 to 2.0 times the thickness $t_a$ of the magnetic metal plate 71'.

FIG. 6A illustrates the laminate 70' in which the magnetic metal plates 71' of four layers are stacked, but the laminate 70' is not limited thereto. The laminate 70' in which the magnetic metal plate 71' of at least one layer and the thermosetting resin layer 72 which is stacked on at least one of the upper and lower portions of the magnetic metal plate 71' are stacked may be formed.

In further detail, the magnetic metal plates 71' of four or more layers may be stacked.

Figure 6B:
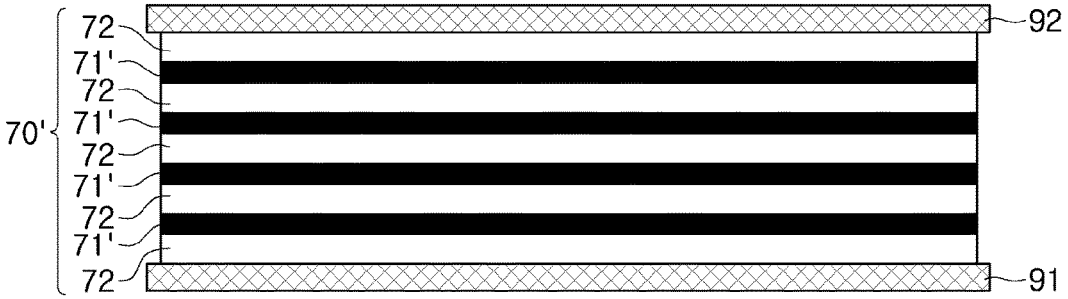

Referring to FIG. 6B, a cover film 92 may be formed on the laminate 70'.

The cover film 92 may serve to fix the laminate 70' so that the magnetic metal plate 71' may be pulverized while being formed as one layer as it is during the pulverization of the magnetic metal plates 71' by compressing the laminate 70'.

The cover film 92 may not be particularly limited as long as it may fix the laminate 70'. For example, a polyethylene terephthalate (PET) film, a polyimide film, a polyester film, a polyphenylene sulfide (PPS) film, a polypropylene (PP) film, a fluorine resin-based film such as polyester terephthalate (PTFE), an epoxy resin film, or the like may be used.

A thickness of the cover film 92 may range from 10 μm to 25 μm.

Figure 6C:
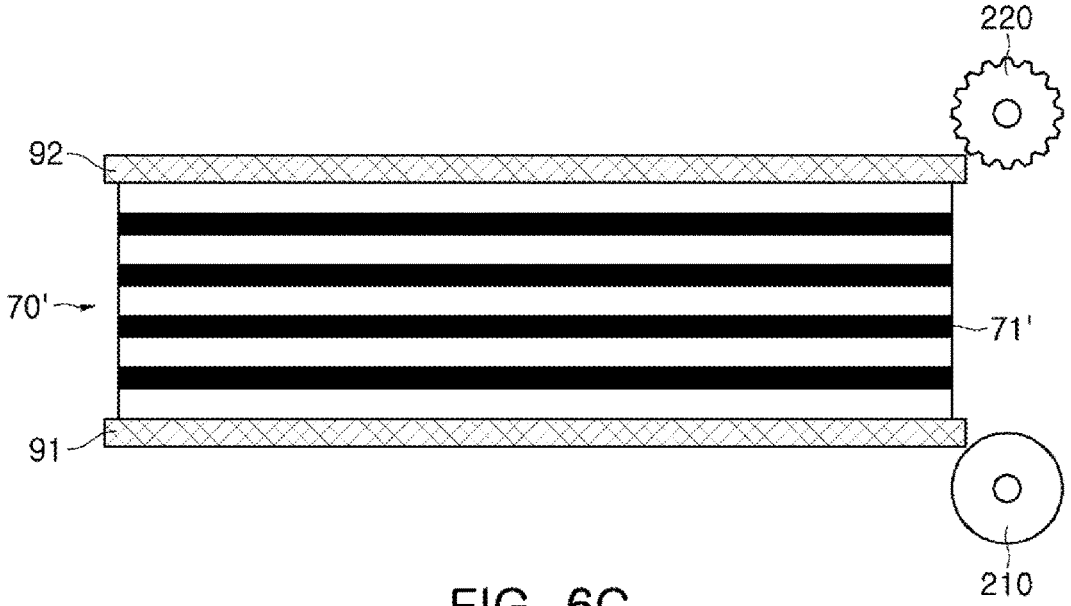

Referring to FIG. 6C, the magnetic metal plates 71' may be pulverized by compressing the laminate 70' on which the support film 91 and the cover film 92 are formed.

When the magnetic metal plates are used in a plate form without being pulverized, the permeability of the magnetic metal plates may be two to ten times higher than that of the magnetic metal powder particles 51, but the core loss of the magnetic metal plate may be greatly increased due to the eddy current and thus the Q factor thereof may deteriorate.

Therefore, according to the exemplary embodiment in the present disclosure, the magnetic metal plates 71' may be pulverized to form the plurality of metal fragments 71*a*, thereby implementing relatively high permeability and reducing core loss.

When the plurality of metal fragments 71*a* are formed by pulverizing the magnetic metal plates 71', permeability thereof may be slightly reduced, but the high permeability may be still exhibited, and the core loss due to the eddy current may be significantly reduced as compared to the degree of reduction in permeability.

A method of pulverizing the magnetic metal plates 71' may be performed, for example, by pulverizing the magnetic metal plates 71 into the plurality of metal fragments 71*a* by forming the laminate 70' and then passing the laminate 70' through rollers 210 and 220 disposed at upper and lower portions of the laminate 70', as illustrated in FIG. 6C.

The magnetic metal plates 71' may be formed using crystalline metal or amorphous metal, but may be more effectively pulverized when the magnetic metal plates 71' are heat-treated to form a crystalloid.

The rollers 210 and 220 may be a metal roller, a rubber roller, etc., and a roller having a plurality of protrusions formed on external surfaces thereof may be used.

The method of pulverizing magnetic metal plates 71' is not limited thereto, but any method capable of pulverizing the magnetic metal plates 71' into the plurality of metal fragments 71*a* to achieve the effect of the present disclosure may be used.

Figure 6D:
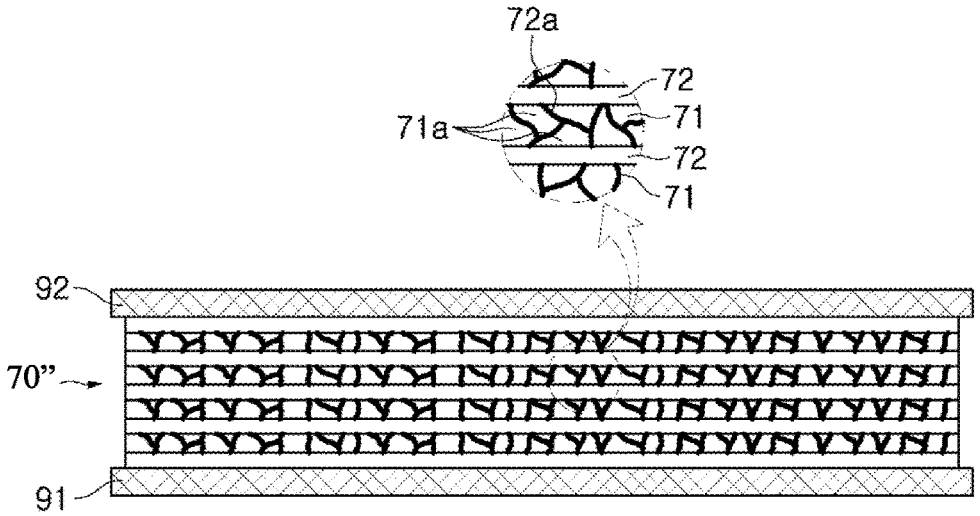

Referring to FIG. 6D, the magnetic metal plates 71 may be pulverized to form the plurality of metal fragments 71*a*.

The magnetic metal plates 71 may be pulverized so that adjacent metal fragments 71*a* may have shapes corresponding to each other.

The metal fragments 71*a* formed by pulverizing the magnetic metal plates are not irregularly dispersed but are positioned to form one layer in the pulverized state in which the adjacent metal fragments 71*a* have shapes corresponding to each other.

For instance, the corresponding shapes of the adjacent metal fragments 71*a* does not mean that the adjacent metal fragments 71*a* exactly match each other but means a degree to which it may be confirmed that the metal fragments 71*a* are positioned while forming one layer in the pulverized state.

The thermosetting resin 72*a* may be disposed in the space between the adjacent metal fragments 71*a* of the pulverized magnetic metal plates 71.

The thermosetting resin 72*a* may be formed by the thermosetting resin of the thermosetting resin layers 72 permeated into the space between the adjacent metal fragments 71*a* during the pulverization of the magnetic metal plates by compressing the laminate 70'.

The thermosetting resin 72*a* disposed in the space between the adjacent metal fragments 71*a* may insulate the adjacent metal fragments 71*a* from each other.

As a result, the core loss of the magnetic metal plate 71 may be reduced and the Q factor thereof may be improved.

Figure 6E:
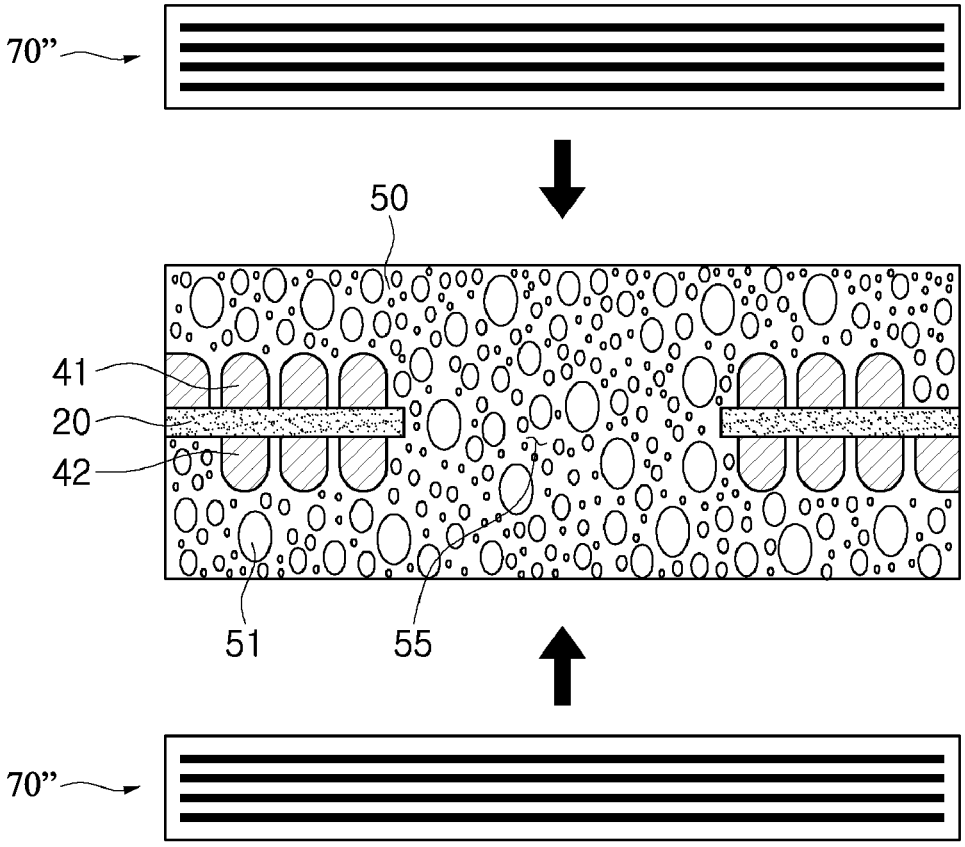

Referring to FIG. 6E, the compressed laminates 70" including the pulverized magnetic metal plates 71 may be formed on the upper and lower portions of the magnetic body 50.

The compressed laminates 70" including the pulverized magnetic metal plates 71 may be disposed on the upper and lower portions of the magnetic body 50, and the magnetic body 50 and the cover parts 70 including the magnetic metal plates 71 may be integrated by being compressed and hardened by the laminate method or the isostatic pressing method.

Figure 7A:
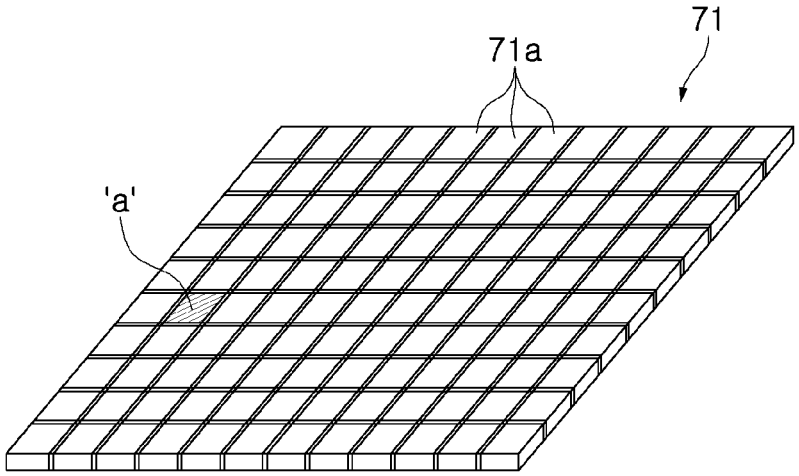
FIGS. 7A and 7B are perspective views schematically illustrating a pulverized form of the magnetic metal plate according to the exemplary embodiment in the present disclosure.
Figure 7B:
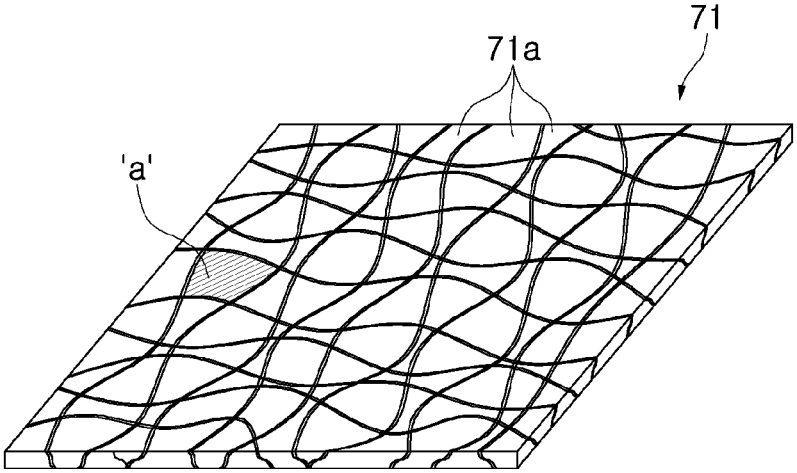

FIGS. 7A and 7B are perspective views schematically illustrating the pulverized form of the magnetic metal plate according to an exemplary embodiment in the present disclosure.

Referring to FIG. 7A, the magnetic metal plate 71 according to the exemplary embodiment in the present disclosure may be pulverized to have lattice-shaped metal fragments 71*a*.

FIG. 7A illustrates the magnetic metal plate 71 pulverized to have the lattice-shaped metal fragments 71*a*, but the magnetic metal plates 71 are not limited thereto. For example, any magnetic metal plate 71 which may be regularly pulverized may be used.

The number, volume, shape, or the like of metal fragments 71*a* formed by regularly pulverizing the magnetic metal plates 71 are not particularly limited and the metal fragments 71*a* having any structure capable of implementing the effect of the present disclosure may be applied.

For example, an area 'a' of a cross section of the metal fragment 71*a* in a length-width (L-W) direction of the metal fragment 71*a* formed by regularly pulverizing the magnetic metal plate 71, for instance, an upper surface or a lower surface of the metal fragment 71*a* may range from 20 $\mu m^2$ to 5,000 $\mu m^2$.

When the area 'a' of the upper surface or the lower surface of the metal fragment 71*a* is less than 20 $\mu m^2$, permeability may be significantly reduced. When the area 'a' of the upper surface or the lower surface of the metal fragment 71*a* exceeds 5,000 $\mu m^2$, the loss due to the eddy current may be increased and the Q factor may deteriorate.

Referring to FIG. 7B, the magnetic metal plate 71 according to another exemplary embodiment in the present disclosure may be pulverized to have atypical metal fragments 71*a*.

The magnetic metal plates 71 are not necessarily be pulverized regularly and as illustrated in FIG. 7B, the magnetic metal plates 71 may be atypically pulverized within the range in which the effect of the present disclosure may be implemented.

An average of the area 'a' of the cross section of the metal fragment 71*a* in the length-width (L-W) direction of the metal fragment 71*a* formed by atypically pulverizing the magnetic metal plate, for instance, the upper surface or the lower surface of the metal fragment 71*a* may range from 20 $\mu m^2$ to 5,000 $\mu m^2$.

The thermosetting resin 72*a* may be disposed in the space between the adjacent metal fragments 71*a* of the pulverized magnetic metal plates 71 and the thermosetting resin 72*a* disposed in the space between the adjacent metal fragments 71*a* may insulate the adjacent metal fragments 71*a* from each other.

FIGS. 8A through 8D are views illustrating a process of forming a cover part of an electronic component including a magnetic metal plate according to another exemplary embodiment in the present disclosure.

Figure 8A:
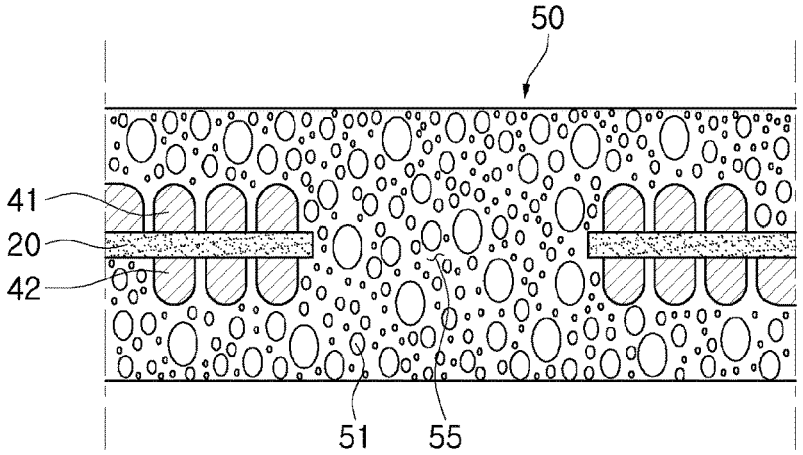
FIGS. 8A through 8D are views illustrating a process of forming a cover part including a magnetic metal plate of an electronic component according to another exemplary embodiment in the present disclosure.

Referring to FIG. 8A, the magnetic body 50 in which the internal coil parts 41 and 42 are embedded may be formed.

The method of forming the magnetic body 50 is not particularly limited, but for example, the magnetic body 50 may be formed by stacking the magnetic sheets 50' as illustrated in FIGS. 5A and 5B.

Figure 8B:
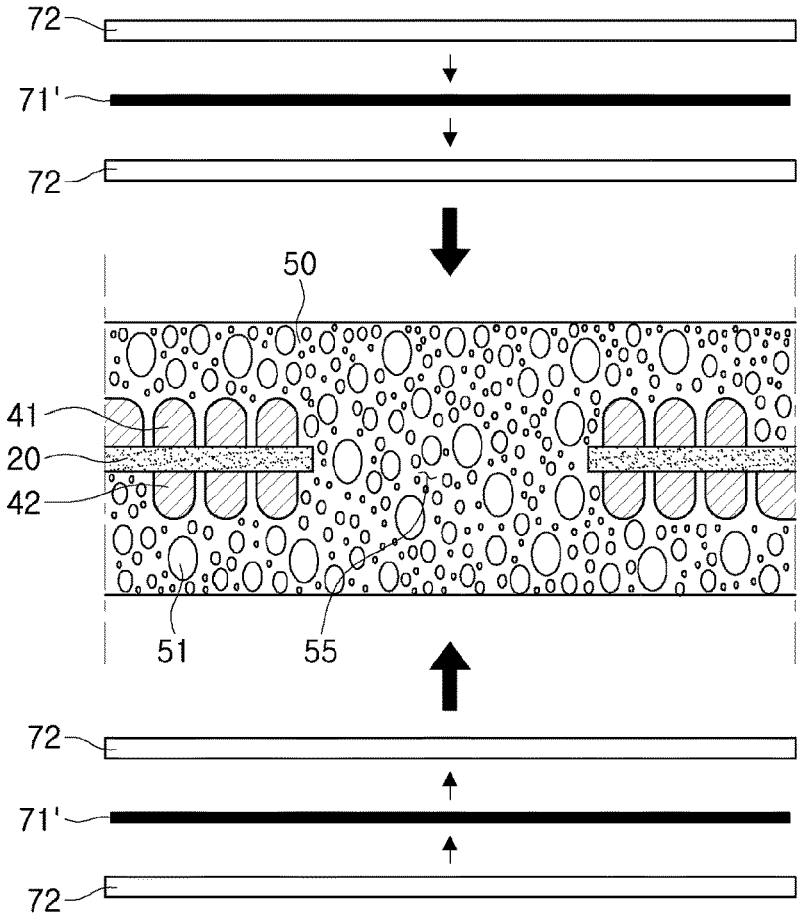

Referring to FIG. 8B, the magnetic metal plates 71' may be stacked on the upper and lower portions of the magnetic body 50.

In this case, the thermosetting resin layer 72 may be stacked on at least one of the upper and lower portions of the magnetic metal plate 71'.

FIG. 8B illustrates that the magnetic metal plate 71' of one layer is stacked above and below the magnetic body 50, respectively, but the magnetic metal plate 71' is not limited thereto. For example, the magnetic metal plate 71' may be stacked on at least one of the upper and lower portions of the magnetic body 50 and the magnetic metal plates 71' of two or more layers may be stacked on the magnetic body 50. When the magnetic metal plates 71' of two or more layers are stacked, the magnetic metal plates 71' and the thermosetting resin layers 72 may be alternately stacked on the magnetic body 50.

Figure 8C:
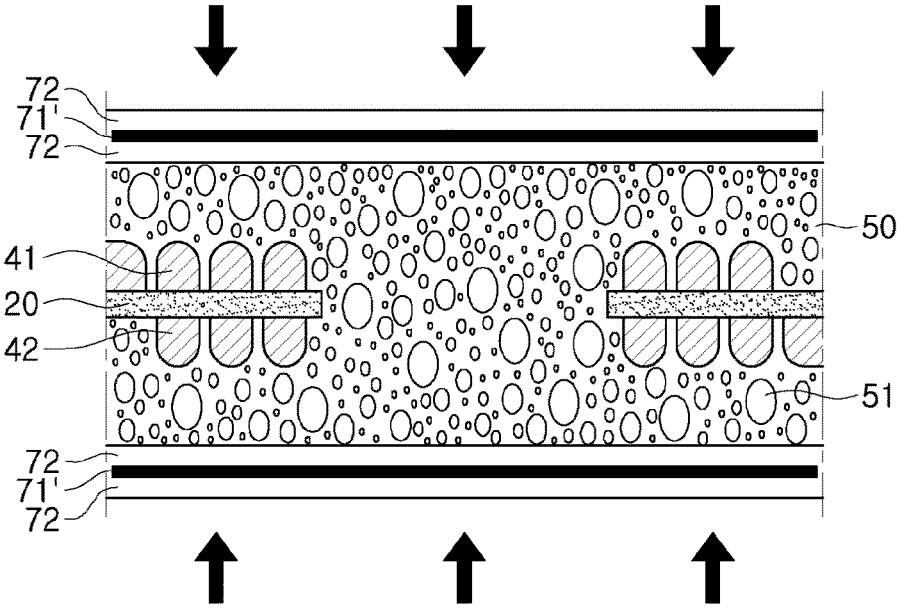

Referring to FIG. 8C, the magnetic metal plates 71' stacked on the magnetic body 50 may be pulverized by being compressed.

For instance, as illustrated in FIGS. 6A through 6E, the magnetic metal plates 71' may be first pulverized such that the magnetic metal plates 71' have the plurality of metal fragments 71*a*, and the magnetic metal plates 71' formed of the plurality of metal fragments 71*a* may be formed on the magnetic body 50, but as illustrated in FIGS. 8A through 8D, the non-pulverized magnetic metal plates 71' according to another exemplary embodiment in the present disclosure may be formed on the magnetic body 50 and then may be pulverized into the plurality of metal fragments 71*a* by the compression.

Figure 8D:
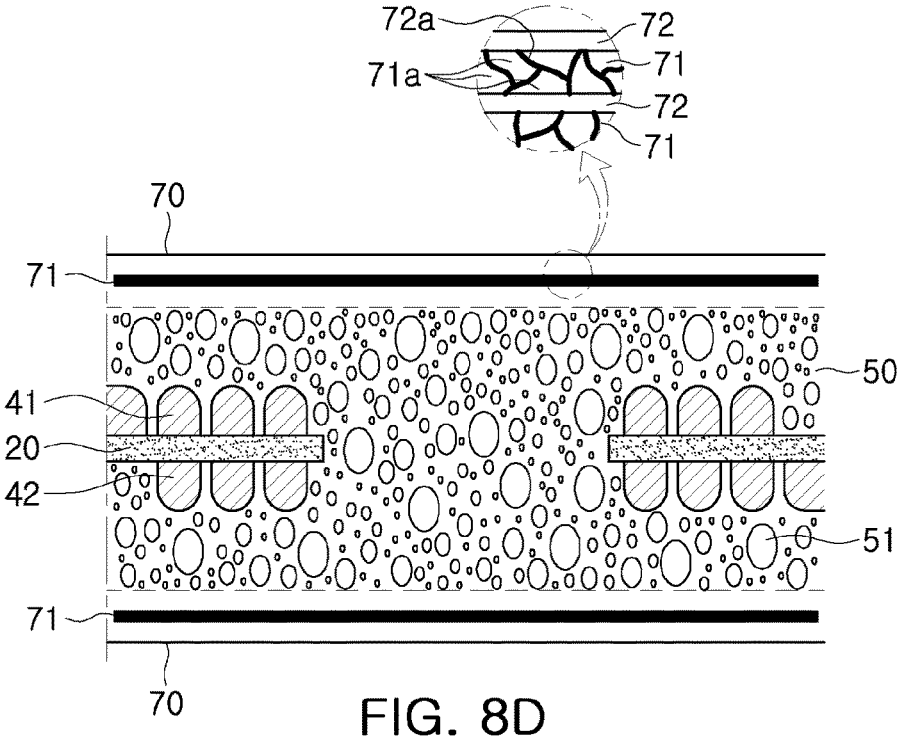

Referring to FIG. 8D, the cover parts 70 including the magnetic metal plates 71 pulverized to have the plurality of metal fragments 71*a* may be formed on the upper and lower portions of the magnetic body 50.

For instance, the non-pulverized magnetic metal plates 71' may be formed on the magnetic body 50 and then the magnetic metal plates may be pulverized by being compressed and hardened by the laminate method or the isostatic pressing method into the plurality of metal fragments 71*a* and the magnetic body 50 and the cover parts 70 including the magnetic metal plates 71 may be integrated.

The thermosetting resin 72*a* may be disposed in the space between the adjacent metal fragments 71*a* of the pulverized magnetic metal plates 71.

The thermosetting resin 72*a* may be formed by the thermosetting resin of the thermosetting resin layers 72 permeated into the space between the adjacent metal fragments 71*a* during the pulverization of the magnetic metal plates by the compression.

The thermosetting resin 72*a* disposed in the space between the adjacent metal fragments 71*a* may insulate the adjacent metal fragments 71*a* from each other.

A surface roughness of the cover part 70 including the magnetic metal plate 71 of the electronic component 100 manufactured according to the exemplary embodiment in the present disclosure may be equal to or less than 0.5 μm.

In the case of another example in which the cover parts including the magnetic metal plates are not formed on the top portion and the bottom portion of the magnetic body, the surface roughness thereof may be relatively large, exceeding 4 μm. In detail, as the magnetic metal powder particles having a relatively large average particle size are used to improve permeability, the surface roughness is getting larger.

The magnetic metal powder particles having a relatively large average particle size may protrude on the surface of the magnetic body, and an insulating coating layer of a protruding portion may be peeled off during a polishing process of the magnetic body cut into individual electronic components, such that defects such as plating spread, or the like, may occur at the time of forming the plating layer on the external electrodes.

However, according to the exemplary embodiment in the present disclosure, the cover parts 70 including the magnetic metal plates 71 may be formed such that the surface roughness may be 0.5 μm or less, and thus, a plating solution spread phenomenon may be prevented.

The magnetic metal plates 71 may be pulverized to have the plurality of metal fragments 71*a*, and the metal fragments 71*a* are not irregularly dispersed after the magnetic metal plates 71 are pulverized, but are positioned while forming one layer as the pulverized state, such that the surface roughness thereof may be 0.5 μm or less unlike the case of the magnetic metal powder particles.

As set forth above, according to exemplary embodiments in the present disclosure, the electronic component having the high inductance and the excellent Q factor and DC-bias characteristics may be manufactured.

While exemplary embodiments have been shown and described above, it will be apparent to those skilled in the art that modifications and variations could be made without departing from the spirit and scope of the present disclosure as defined by the appended claims.

What is claimed is:

1. A method of manufacturing an electronic component, comprising:

forming a magnetic body in which internal coil parts are embedded;

forming at least one laminate by stacking thermosetting resin layers on upper and lower portions of a magnetic metal plate to form each of the at least one laminate;

stacking the at least one laminate on at least one of upper and lower portions of the magnetic body thereby forming a laminated magnetic body; and after forming the laminated magnetic body, compressing the laminated magnetic body to thereby puilverize the magnetic metal plate of the at least one laminate to have a plurality of metal fragments therein, thereby forming the at least one laminate having the pulverized metal plate stacked on the magnetic body into at least one cover part covering the magnetic body.

2. The method of claim 1, wherein a thermosetting resin of the thermosetting resin layer fills a space between adjacent metal fragments of the pulverized magnetic metal plate.

3. The method of claim 1, wherein the pulverized magnetic metal plate has adjacent metal fragments having shapes corresponding to each other.

4. The method of claim 1, wherein the plurality of metal fragments of the pulverized magnetic metal plate have regular shapes.

5. The method of claim 1, wherein the plurality of metal fragments of the pulverized magnetic metal plate have atypical shapes.

6. The method of claim 1, wherein an area of an upper surface or a lower surface of the metal fragment ranges from 20 $\mu m^2$ to 5,000 $\mu m^2$.

7. The method of claim 1, wherein the cover part comprises a plurality of stacked magnetic metal plates.

8. The method of claim 7, wherein the cover part comprises the magnetic metal plates and thermosetting resin layers which are alternately stacked.

9. The method of claim 8, wherein a thickness of each thermosetting resin layer is 1.0 to 2.5 times a thickness of each magnetic metal plate.

10. The method of claim 8, wherein a thickness of each thermosetting resin layer is 1.5 to 2.0 times a thickness of each magnetic metal.

11. The method of claim 1, wherein a thickness of the magnetic metal plate ranges from 5 μm to 50 μm.

12. The method of claim 1, wherein a thickness of the cover part ranges from 10% to 30% of a thickness of the magnetic body.

13. The method of claim 1, wherein a surface roughness of the cover part including the magnetic metal plate is equal to or less than 0.5 μm.

14. The method of claim 1, wherein a permeability of the magnetic metal plate is two to ten times greater than that of magnetic metal powder particles dispersed in the magnetic body.

15. A method of manufacturing an electronic component, comprising:

forming a magnetic body embedded with internal coil parts; and forming a cover part including a pulverized magnetic metal plate on at least one of upper and lower portions of the magnetic body, wherein the cover part further includes thermosetting resin layers surrounding the pulverized magnetic metal plate, the forming of the cover part including the pulverized magnetic metal plate comprises:

stacking the thermosetting resin layers on opposite surfaces of a non-pulverized magnetic metal plate to form a laminate;

pulverizing the non-pulverized magnetic metal plate into the plurality of metal fragments by compressing the laminate; and disposing the compressed laminate on at least one of upper and lower portions of the magnetic body to form the cover part, and the pulverizing of the non-pulverized magnetic metal plate comprises:

forming the laminate on a support film and forming a cover film on the laminate;

compressing the support film and the cover film against each other so as to pulverize the laminate interposed therebetween; and removing the support film and the cover film from the laminate.

16. The method of claim 15, wherein a thermosetting resin of the thermosetting resin layer fills a space between adjacent metal fragments of the pulverized magnetic metal plate.

17. The method of claim 15, wherein the non-pulverized magnetic metal plate is formed of crystalline metal or amorphous metal including at least one selected from the group consisting of iron (Fe), silicon (Si), boron (B), chromium (Cr), aluminum (Al), copper (Cu), niobium (Nb), and nickel (Ni).

* * * * *